US011475809B2

(12) United States Patent
Yang et al.

(10) Patent No.: US 11,475,809 B2
(45) Date of Patent: Oct. 18, 2022

(54) DRIVING CIRCUIT OF DISPLAY PANEL, DISPLAY PANEL, AND DISPLAY DEVICE

(71) Applicants: Beijing BOE Display Technology Co., Ltd., Beijing (CN); BOE Technology Group Co., Ltd., Beijing (CN)

(72) Inventors: Bingqing Yang, Beijing (CN); Wenkai Mu, Beijing (CN); Shijun Wang, Beijing (CN); Wenjun Xiao, Beijing (CN); Ji Dong, Beijing (CN); Tianxin Zhao, Beijing (CN); Bo Feng, Beijing (CN); Xiaoxiao Chen, Beijing (CN); Zhiying Bao, Beijing (CN); Haoliang Ji, Beijing (CN); Hao Xu, Beijing (CN); Yang Wang, Beijing (CN)

(73) Assignees: BEIJING BOE DISPLAY TECHNOLOGY CO., LTD., Beijing (CN); BEIJING BQE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/293,938

(22) PCT Filed: Sep. 30, 2020

(86) PCT No.: PCT/CN2020/119505
§ 371 (c)(1),
(2) Date: May 14, 2021

(87) PCT Pub. No.: WO2021/068844
PCT Pub. Date: Apr. 15, 2021

(65) Prior Publication Data

US 2022/0013050 A1 Jan. 13, 2022

(30) Foreign Application Priority Data

Oct. 10, 2019 (CN) ..... 201921695273.7

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2310/08* (2013.01); *G09G 2330/04* (2013.01)

(58) Field of Classification Search
CPC ..... G09G 3/3685; G09G 3/3266; G09G 2310/0267; G09G 2310/06; G09G 2310/08; G09G 2330/04; G09G 3/006; G09G 3/20
See application file for complete search history.

(56) References Cited

U.S. PATENT DOCUMENTS

2007/0279355 A1 12/2007 Hirata et al.
2008/0129717 A1* 6/2008 Lee ..... G09G 3/3611 345/204

(Continued)

FOREIGN PATENT DOCUMENTS

CN 102650785 A 8/2012
CN 104793795 A 7/2015

(Continued)

*Primary Examiner* — Gerald Johnson
(74) *Attorney, Agent, or Firm* — Fay Sharpe LLP

(57) ABSTRACT

A driving circuit for a display panel, a display panel, and a display device are provided. The driving circuit includes a plurality of driving units, wherein at least one of the driving units includes M dummy pins, at least one of the M dummy pins is configured to be electrically connected to at least one clock pin of the display panel, and M is an integer greater than or equal to 1.

20 Claims, 7 Drawing Sheets

(56) References Cited

U.S. PATENT DOCUMENTS

| | | | | |
|---|---|---|---|---|
| 2014/0104322 | A1 | 4/2014 | Xu et al. | |
| 2014/0347593 | A1* | 11/2014 | Han | G02F 1/13458 349/54 |
| 2017/0196080 | A1 | 7/2017 | Meng et al. | |
| 2018/0061350 | A1* | 3/2018 | Sung | G09G 3/3696 |
| 2018/0082929 | A1 | 3/2018 | Lai et al. | |
| 2018/0211582 | A1 | 7/2018 | Sakariya et al. | |
| 2019/0385497 | A1 | 12/2019 | Huang et al. | |

FOREIGN PATENT DOCUMENTS

| | | | | | |
|---|---|---|---|---|---|
| CN | 105529003 | A | | 4/2016 | |
| CN | 105632382 | A | | 6/2016 | |
| CN | 107068039 | A | | 8/2017 | |
| CN | 107247373 | A | | 10/2017 | |
| CN | 107331294 | A | | 11/2017 | |
| CN | 107463014 | A | | 12/2017 | |
| CN | 206864162 | U | | 1/2018 | |
| CN | 109448627 | A | * | 3/2019 | G09G 3/20 |
| CN | 109872674 | A | | 6/2019 | |
| CN | 210429262 | U | | 4/2020 | |
| EP | 0845697 | A1 | * | 6/1998 | G02F 1/1343 |
| JP | 2007322580 | A | | 12/2007 | |

* cited by examiner

DRIVING CIRCUIT OF DISPLAY PANEL, DISPLAY PANEL, AND DISPLAY DEVICE

The present application is a 371 of PCT Patent Application Serial No. PCT/CN2020/119505, filed on Sep. 30, 2020, which claims priority to Chinese Patent Application No. 201921695273.7, filed on Oct. 10, 2019 and with the utility model title "DRIVING CIRCUIT FOR DISPLAY PANEL, DISPLAY PANEL, AND DISPLAY DEVICE", both of which are incorporated herein by reference in their entirety.

TECHNICAL FIELD

The present disclosure relates to a driving circuit for a display panel, a display panel, and a display device.

BACKGROUND

The display device usually includes a display panel and a driving circuit. Both the driving circuit and the display panel may include clock pins. The clock pin of the driving circuit is electrically connected to the clock pin of the display panel, so that the driving circuit can provide a clock signal to the display panel.

SUMMARY

The embodiments of the present disclosure provide a driving circuit for a display panel, a display panel, and a display device, which help to improve the compatibility of the driving circuit.

In a first aspect, a driving circuit for a display panel is provided. The driving circuit includes:

a plurality of driving units, wherein at least one of the driving units includes M dummy pins, and at least one of the M dummy pins is configured to be electrically connected to at least one clock pin of the display panel, and M is an integer greater than or equal to 1.

Optionally, at least one of the driving units further includes a test pin configured to be electrically connected to a test line of the display panel, so as to transmit a test signal to the test line during a test phase of the display panel and ground the test line during a display phase of the display panel.

Optionally, at least one of the driving units further includes a feed pin configured to be electrically connected to a common electrode line of the display panel and transmit a feed signal or a compensation signal to the common electrode line.

Optionally, the driving units are arranged in a target direction, the driving units respectively include grounding pins, and at least one grounding pin of one of any two adjacent driving units is electrically connected to at least one grounding pin of the other driving unit.

Optionally, the driving units at two ends of the driving units are respectively a first driving unit and a second driving unit, and the driving units between the first driving unit and the second driving unit are third driving units; the first driving unit and the second driving unit respectively include the M dummy pins and a first grounding pin, and each of the third driving units includes a first grounding pin and a second grounding pin;

the first grounding pin of the first driving unit is electrically connected to the first grounding pin of the third driving unit adjacent thereto, the first grounding pin of the second driving unit is electrically connected to the second grounding pin of the third driving unit adjacent thereto, and the first grounding pin of each of other third driving units is electrically connected to the second grounding pin of the third driving unit adjacent thereto and located therebefore, and the second grounding pin of each of other third driving units is electrically connected to the first grounding pin of the third driving unit adjacent thereto and located thereafter, and the other third driving units are third driving units other than a third driving unit adjacent to the first driving unit and a third driving unit adjacent to the second driving unit; and the first grounding pin and the second grounding pin are respectively configured to be electrically connected to a peripheral ground line of the display panel.

Optionally, the first driving unit and the second driving unit further respectively include a second grounding pin, and the third driving units further each includes a third grounding pin and a fourth grounding pin;

the second grounding pin of the first driving unit is electrically connected to the third grounding pin of the third driving unit adjacent thereto, the second grounding pin of the second driving unit is electrically connected to the fourth grounding pin of the third driving unit adjacent thereto; and the third grounding pin of each of the other third driving units is electrically connected to the fourth grounding pin of the third driving unit adjacent thereto and located therebefore, the fourth grounding pin of each of the other third driving units is electrically connected to the third grounding pin of the third driving unit adjacent thereto and located thereafter; and the second grounding pin, the third grounding pin, and the fourth grounding pin are respectively configured to be electrically connected to a peripheral ground line of the display panel.

Optionally, at least one of the first driving unit and the second driving unit further includes a third grounding pin and a fourth grounding pin;

the third grounding pin is configured to be electrically connected to a peripheral ground line of the display panel; and the fourth grounding pins of the first driving unit and the second driving unit are configured to be electrically connected to the silver glue dots of the display panel through silver glue dot ground lines.

Optionally, the driving units are arranged in a target direction, the driving units at two ends of the driving units are respectively a first driving unit and a second driving unit, the driving units between the first driving unit and the second driving unit are third driving units; the first driving unit and the second driving unit respectively include the M dummy pins, the test pin, the feed pin, the first grounding pin, the second grounding pin, the third grounding pin, and the fourth grounding pin; and each of the third driving units includes a first grounding pin, a second grounding pin, a third grounding pin, and a fourth grounding pin;

in the first driving unit: the third grounding pin, the fourth grounding pin, the test pin, the M dummy pins, the feed pin, the first grounding pin and the second grounding pin are arranged sequentially in a direction of approaching the second driving unit;

in the second driving unit: the third grounding pin, the fourth grounding pin, the test pin, the M dummy pins, the feed pin, the first grounding pin and the second grounding pin are arranged sequentially in a direction of approaching the first driving unit;

in the third driving unit: the third grounding pin, the first grounding pin, the second grounding pin, and the fourth grounding pin are arranged sequentially in a direction from the first driving unit to the second driving unit;

the first grounding pin of the first driving unit is electrically connected to the first grounding pin of the third driving unit adjacent thereto, and the second grounding pin of the first driving unit is electrically connected to the third grounding pin of the third driving unit;

the first grounding pin of the second driving unit is electrically connected to the second grounding pin of the third driving unit adjacent thereto, and the second grounding pin of the second driving unit is electrically connected to the fourth grounding pin of the third driving unit;

the first grounding pin of each of other third driving units is electrically connected to the second grounding pin of the third driving unit adjacent thereto and located therebefore, the second grounding pin of each of other third driving units is electrically connected to the first grounding pin of the third driving unit adjacent thereto and located thereafter, and the third grounding pin of each of other third driving units is electrically connected to the fourth grounding pin of the third driving unit adjacent thereto and located therebefore, the fourth grounding pin of each of other third driving units is electrically connected to the third grounding pin of the third driving unit adjacent thereto and located thereafter, wherein the other third driving units are third driving units other than the third driving unit adjacent to the first driving unit and the third driving unit adjacent to the second driving unit;

the test pin is configured to be electrically connected to the test line of the display panel, transmit a test signal to the test line during a test phase of the display panel and ground the test line during a display phase of the display panel;

the feed pin is configured to be electrically connected to a common electrode line of the display panel and transmit a feed signal or a compensation signal to the common electrode line; and the fourth grounding pins of the first driving unit and the second driving unit are configured to be electrically connected to silver glue dots of the display panel through silver glue dot ground lines, and the other grounding pins are configured to be electrically connected to a peripheral ground line of the display panel.

Optionally, at least one of the driving units includes 10 dummy pins.

Optionally, each of the driving units includes a plurality of pins, the width of the pin is 16 to 18 microns, and a spacing between any two adjacent pins is 16 to 18 microns.

Optionally, the driving circuit is a chip-on-film circuit.

In a second aspect, a display panel is provided, which includes:

at least one clock pin, wherein the at least one clock pin is configured to be electrically connected to at least one of M dummy pins of at least one driving unit of a driving circuit for the display panel, and M is an integer greater than or equal to 1.

Optionally, the display panel has a display area and a non-display area, and the display panel further includes:

a test line located in the non-display area, wherein the test line is configured to be electrically connected to a test pin in at least one driving unit of the driving circuit, to receive a test signal transmitted by the test pin during a test phase of the display panel and to be grounded by the test pin during a display phase of the display panel.

Optionally, the display panel further includes a common electrode line located in the display area, at least one driving unit of the driving circuit further includes a feed pin, and the common electrode line is configured to be electrically connected to a feed pin in at least one driving unit of the driving circuit to receive a feed signal or a compensation signal transmitted by the feed pin.

Optionally, the display panel further includes a peripheral ground line located in the non-display area at the periphery of the display area and located on a side of the test line away from the display area;

the driving circuit includes a plurality of driving units arranged in a target direction, and the driving units at two ends of the driving units are respectively a first driving unit and a second driving unit, the driving units between the first driving unit and the second driving unit are third driving units; the first driving unit and the second driving unit respectively include the M dummy pins, the test pin, the feed pin, the first grounding pin, the second grounding pin, and the third grounding pin; each of the third driving units includes a first grounding pin, a second grounding pin, a third grounding pin, and a fourth grounding pin; and the peripheral ground line is configured to be electrically connected to the first, second, third, and fourth grounding pins.

Optionally, the display panel further includes silver glue dots located in the non-display area;

the first driving unit and the second driving unit further respectively include a fourth grounding pin; and the silver glue dots are configured to be electrically connected to the fourth grounding pins of the first driving unit and the second driving unit through silver glue dot ground lines.

In a third aspect, a display device is provided. The display device includes:

a display panel and a driving circuit, wherein the driving circuit is located on at least one side of the display panel;

the display panel includes at least one clock pin;

the driving circuit includes a plurality of driving units, at least one of the driving units includes M dummy pins, and M is an integer greater than or equal to 1; and at least one of the M dummy pins is electrically connected to the at least one clock pin.

Optionally, the display panel has a display area and a non-display area, and the display panel further includes a test line located in the non-display area;

at least one of the driving units further includes a test pin electrically connected to the test line; and wherein the test pin is configured to transmit a test signal to the test line during a test phase of the display panel, and to ground the test line during a display phase of the display panel.

Optionally, the display panel further includes a common electrode line located in the display area;

at least one of the driving units further includes a feed pin electrically connected to the common electrode line;

the feed pin is configured to transmit a feed signal or a compensation signal to the common electrode line.

Optionally, the driving units are arranged in a target direction, the driving units respectively include a grounding pin, and at least one grounding pin of one of any two adjacent driving units is electrically connected to at least one grounding pin of the other driving unit.

Optionally, the display panel further includes a peripheral ground line located in the non-display area at the periphery of the display area and located on a side of the test line away from the display area;

the driving units at two ends of the driving units are respectively a first driving unit and a second driving unit, the driving units between the first driving unit and the second driving unit are third driving units; the first driving unit and the second driving unit respectively include the M dummy pins and a first grounding pin, and each of the third driving units includes a first grounding pin and a second grounding pin;

the first grounding pin of the first driving unit is electrically connected to the first grounding pin of the third driving unit adjacent thereto, the first grounding pin of the second driving unit is electrically connected to the second grounding pin of the third driving unit adjacent thereto; the first grounding pin of each of the other third driving units is electrically connected to the second grounding pin of the third driving unit adjacent thereto and located therebefore, the second grounding pin of each of the other third driving units is electrically connected to the first grounding pin of the third driving unit adjacent thereto and located thereafter, wherein the other third driving units are third driving units other than a third driving unit adjacent to the first driving unit and a third driving unit adjacent to the second driving unit; and the first grounding pins and the second grounding pins are respectively electrically connected to the peripheral ground line.

Optionally, the first driving unit and the second driving unit further respectively include a second grounding pin, and the third driving units further each include a third grounding pin and a fourth grounding pin;

the second grounding pin of the first driving unit is electrically connected to the third grounding pin of the third driving unit adjacent thereto, the second grounding pin of the second driving unit is electrically connected to the fourth grounding pin of the third driving unit adjacent thereto; and the third grounding pin of each of the other third driving units is electrically connected to the fourth grounding pin of the third driving unit adjacent thereto and located therebefore, the fourth grounding pin of each of the other third driving units is electrically connected to the third grounding pin of the third driving unit adjacent thereto and located thereafter; and the second ground pins, the third ground pins, and the fourth ground pins are respectively electrically connected to the peripheral ground line.

Optionally, the display panel further includes a silver glue dot located in the non-display area; and at least one of the first driving unit and the second driving unit further includes a third grounding pin and a fourth grounding pin, and the third grounding pin is electrically connected to the peripheral ground line, the fourth grounding pin is electrically connected to the silver glue dot through a silver glue dot ground line.

Optionally, the display panel has a display area and a non-display area, and the display panel further includes a test line, a peripheral ground line, a common electrode line, and a silver glue dot; the test line is located in the non-display area, the common electrode line is located in the display area, the peripheral ground line is located in the non-display area at the periphery of the display area and is located on a side of the test line away from the display area, the silver glue dot is located in the non-display area;

the driving units are arranged in a target direction, and the driving units at two ends are respectively a first driving unit and a second driving unit, and the driving units between the first driving unit and the second driving unit are third driving units; the first driving unit and the second driving unit respectively include the M dummy pins, a test pin, a feed pin, a first grounding pin, a second grounding pin, a third grounding pin, and a fourth grounding pin, each of the third driving units includes a first grounding pin, a second grounding pin, a third grounding pin, and a fourth grounding pin;

in the first driving unit: the third grounding pin, the fourth grounding pin, the test pin, the M dummy pins, the feed pin, the first grounding pin, and the second grounding pin are arranged sequentially in a direction of approaching the second driving unit;

in the second driving unit: the third grounding pin, the fourth grounding pin, the test pin, the M dummy pins, the feed pin, the first grounding pin, and the second grounding pin are arranged sequentially in a direction of approaching the first driving unit;

in the third driving unit: the third grounding pin, the first grounding pin, the second grounding pin, and the fourth grounding pin are arranged sequentially in a direction from close to the first driving unit to close to the second driving unit;

the first grounding pin of the first driving unit is electrically connected to the first grounding pin of the third driving unit adjacent thereto, and the second grounding pin of the first driving unit is electrically connected to the third grounding pin of the third driving unit;

the first grounding pin of the second driving unit is electrically connected to the second grounding pin of the third driving unit adjacent thereto, and the second grounding pin of the second driving unit is electrically connected to the fourth grounding pin of the third driving unit;

the first grounding pin of each of other third driving units is electrically connected to the second grounding pin of the third driving unit adjacent thereto and located therebefore, the second grounding pin of each of other third driving units is electrically connected to the first grounding pin of the third driving unit adjacent thereto and located thereafter, the third grounding pin of each of other third driving units is electrically connected to the fourth grounding pin of the third driving unit adjacent thereto and located therebefore, the fourth grounding pin of each of other third driving units is electrically connected to the third grounding pin of the third driving unit adjacent thereto and located thereafter, wherein the other third driving units are third driving units other than the third driving unit adjacent to the first driving unit and the third driving unit adjacent to the second driving unit;

the test pin is electrically connected to the test line, and the test pin is configured to transmit a test signal to the test line during a test phase of the display panel, and ground the test line during a display phase of the display panel;

the feed pin is electrically connected to the common electrode line, and the feed pin is configured to transmit a feed signal or a compensation signal to the common electrode line; and the fourth grounding pins of the first driving unit and the second driving unit are electrically connected to the silver glue dots through silver glue dot ground lines, and other grounding pins are electrically connected to the peripheral ground line.

Optionally, at least one of the driving units includes 10 dummy pins.

Optionally, each of the driving units includes a plurality of pins, the width of the pin is 16 to 18 microns, and the spacing between any two adjacent pins is 16 to 18 microns.

Optionally, the driving circuit is a chip-on-film circuit.

DETAILED DESCRIPTION

For clearer descriptions of the principles, technical solutions, and advantages of the present disclosure, embodiments of the present disclosure are further described in detail hereinafter with reference to the accompanying drawings.

A display device usually includes a display panel and a driving circuit, and the driving circuit may be, for example, a chip-on-film (also referred as COF) circuit.

In the current display device, the driving circuit and the display panel are matched and used together according to the pin specifications. A driving circuit with one pin specification can only be applied to a display panel with one pin specification, which makes the driving circuit unable to compatible with display panels with different pin specifications, and the compatibility of the driving circuit is poor. The pin specifications may include the width of the pin, the spacing between adjacent pins, the arrangement of the pins, and the definition of the pins (such as clock pin, grounding pin, etc.) and the like. For example, the driving circuit and the display panel respectively include a plurality of clock pins with the same pin specification, and the plurality of clock pins of the driving circuit and the plurality of clock pins of the display panel are electrically connected in a one-to-one correspondence.

In view of this, embodiments of the present disclosure provide a driving circuit for a display panel, a display panel, and a display device. The driving circuit includes a plurality of driving units, and at least one of the driving units includes M Dummy pins. At least one of the M dummy pins is configured to be electrically connected to at least one clock pin of the display panel. Therefore, the driving circuit may be electrically connected to any display panel with the number of clock pins less than or equal to M, so that the driving circuit may be compatible with any display panel with the number of clock pins less than or equal to M. That is, the driving circuit may be used as a driving circuit for any display panel with the number of clock pins less than or equal to M. The driving circuit has high compatibility. The detailed schemes of the present disclosure are referred to the following embodiments.

Figure 1:
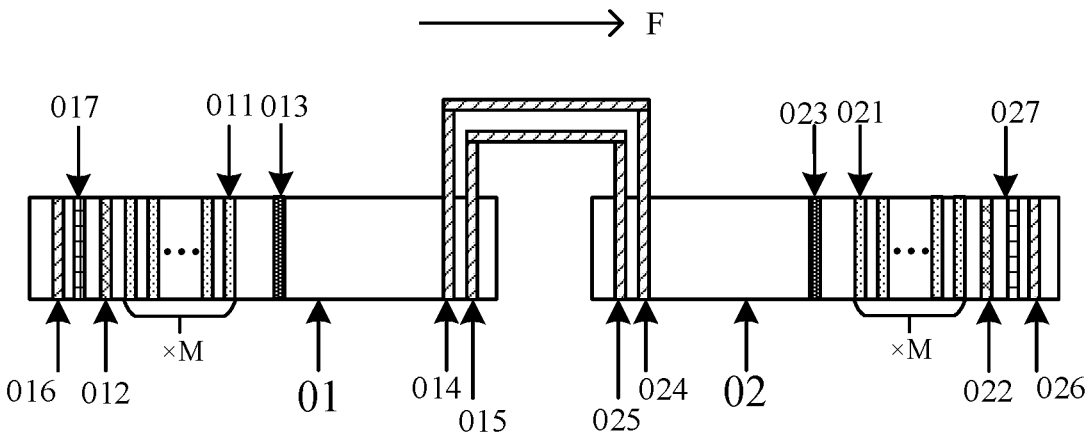
FIG. 1 is a schematic diagram of a driving circuit for a display panel according to embodiments of the present disclosure.

Referring to FIG. 1, which shows a schematic diagram of a driving circuit for a display panel according to embodiments of the present disclosure, the driving circuit includes a plurality of driving units, and at least one of the driving units includes M dummy pins. At least one of the M dummy pins is configured to be electrically connected to at least one clock pin (not shown in FIG. 1) of the display panel (not shown in FIG. 1), and M is an integer greater than or equal to 1. For example, in FIG. 1, the driving circuit includes two driving units, that is, the driving unit 01 and the driving unit 02. The driving unit 01 includes M dummy pins 011, and the driving unit 02 includes M dummy pins 021. At least one of the M dummy pins 011 and/or at least one of the M dummy pins 021 are/is configured to be electrically connected to at least one clock pin of the display panel.

In summary, in the driving circuit for the display panel according to the present disclosure, at least one of the driving units of the driving circuit includes M dummy pins, and at least one of the M dummy pins is configured to be electrically connected to at least one clock pin of the display panel. Therefore, the driving circuit may be electrically connected to any display panel with the number of clock pins less than or equal to M, and the driving circuit may be compatible with any display panel with the number of clock pins less than M, which helps to improve the compatibility of the driving circuit.

Optionally, at least one of the driving units further includes a test pin configured to be electrically connected to a test line of the display panel. The test pin may be configured to transmit a test signal to the test line during a test phase of the display panel and to ground the test line during a display phase of the display panel. For example, as shown in FIG. 1, the driving unit 01 includes a test pin 012, and the driving unit 02 includes a test pin 022. The test pin 012 and the test pin 022 may be configured to be electrically connected to different test lines (not shown in FIG. 1) of the display panel, or the test pin 012 and the test pin 022 may be configured to be electrically connected to the same test line of the display panel, which is not limited in the embodiments of the present disclosure. Both the test pin 012 of the driving unit 01 and the test pin 022 of the driving unit 02 are configured to transmit test signals to the test line(s) during the test phase of the display panel, and to ground the test line(s) during the display phase of the display panel.

The test line of the display panel described in the embodiments of the disclosure may be an Array Test (also referred as AT) line. The test line is generally electrically connected to an AT circuit of a display panel motherboard. The display panel motherboard includes a plurality of display panels, the test line is located inside the display panel, and the AT circuit is located outside the display panel. The AT circuit is configured to test the display panel by transmitting a test signal to the display panel through the test line. After the test is completed, the display panel motherboard is generally cut into individual display panels. In the process of cutting, the test line electrically connected to the AT circuit is also cut off, thereby forming a fracture of the test line in the final individual display panel. The fracture is easy to cause static electricity, which is easy to affect or even destroy (for example, breakdown) the display panel. In the embodiments of the present disclosure, since the test line is electrically connected to the test pin of the driving circuit, after the test is completed, the test line may be grounded through the test pin, thereby preventing static electricity from damaging the display panel.

Optionally, at least one of the driving units further includes a feed pin configured to be electrically connected to a common electrode line of the display panel. The feed pin is configured to transmit a feed signal or a compensation signal to the common electrode line, and the compensation signal may be a common electrode signal. For example, as shown in FIG. 1, the driving unit 01 includes a feed pin 013, and the driving unit 02 includes a feed pin 023. The feed pin 013 and the feed pin 023 may be configured to be electrically connected to different common electrode lines of the display panel, or the feed pin 013 and the feed pin 023 may be configured to be electrically connected to the same common electrode line of the display panel, which is not limited in the embodiments of the present disclosure. The feed pin 013 and the feed pin 023 are respectively configured to transmit a feed signal or a compensation signal to the common electrode line connected thereto. That is, the feed pin 013 may transmit a feed signal or a compensation signal to the common electrode line connected to the feed pin 013, and the feed pin 023 may transmit a feed signal or a compensation signal to the common electrode line connected to the feed pin 023, which is not limited in the embodiments of the present disclosure.

Optionally, in the driving circuit for the display panel according to the embodiments of the present disclosure, a plurality of driving units are arranged in a target direction F, and the driving units respectively include a grounding pin, and at least one grounding pin of one of any two adjacent driving units is electrically connected to at least one grounding pin of the other driving unit. The display panel may be a rectangular panel. After the driving circuit is electrically connected to the display panel, the driving units may be located on the same side of the display panel and arranged along the same side edge of the display panel. The target direction may be parallel to the side edge. In the embodiments of the present disclosure, since at least one grounding pin of one of any two adjacent driving units in the driving units is electrically connected to at least one grounding pin of the other driving unit, the influence of static electricity on the drive signal of an individual driving unit can be reduced, so that the transmission of the drive signal is more stable.

In an exemplary embodiment, when the driving units includes only the driving unit 01 and the driving unit 02, as shown in FIG. 1, the driving unit 01 includes a first grounding pin 014 and a second grounding pin 015, and the driving unit 02 includes a first grounding pin 024 and a second grounding pin 025. The first grounding pin 014 is electrically connected to the first grounding pin 024, and the second grounding pin 015 is electrically connected to the second grounding pin 025.

Optionally, as shown in FIG. 1, the driving unit 01 further includes a third grounding pin 016 and a fourth grounding pin 017, and the driving unit 02 further includes a third grounding pin 026 and a fourth grounding pin 027. The third grounding pin 016 and the third grounding pin 026 are configured to be electrically connected to a peripheral ground line of the display panel, and the fourth grounding pin 017 and the fourth grounding pin 027 are configured to electrically connected to the silver glue dots of the display panel through the silver glue dot ground lines (not shown in FIG. 1), so that the grounding pins of the driving circuit may ground the peripheral ground line and the silver glue dot ground lines, which can prevent static electricity from damaging the display panel. For example, the third grounding pin 016 of the driving unit 01 and the third grounding pin 026 of the driving unit 02 are configured to be electrically connected to both ends of the peripheral ground line, and the fourth grounding pin 017 of the driving unit 01 and the fourth grounding pin 027 of the driving unit 02 are configured to be electrically connected to different silver glue dots of the display panel through different silver glue dot ground lines.

Figure 2:
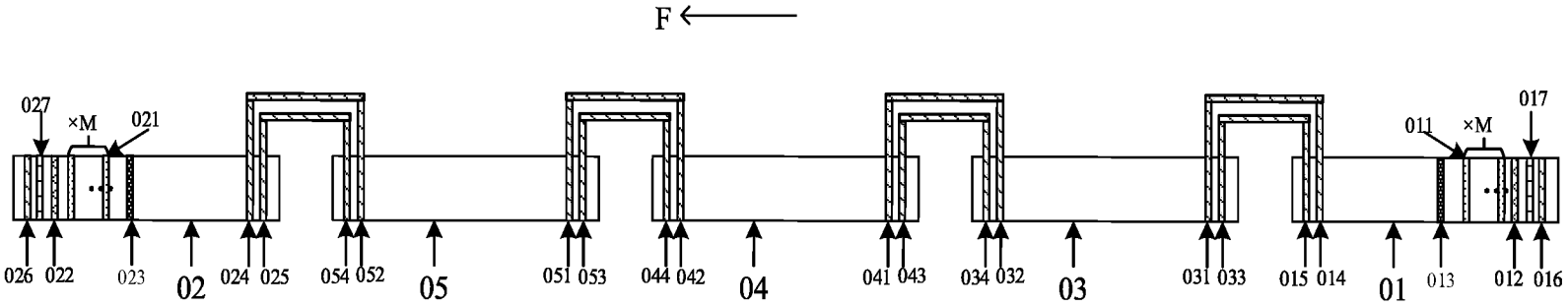
FIG. 2 is a schematic diagram of another driving circuit for a display panel according to embodiments of the present disclosure.

Optionally, referring to FIG. 2, which shows a schematic diagram of another driving circuit for display panel according to embodiments of the present disclosure, the driving circuit includes a plurality of driving units. In FIG. 2, for example, the driving circuit includes five driving units. As shown in FIG. 2, the driving units are arranged in the target direction F, and the driving units at two ends of the driving units are a first driving unit and a second driving unit, the driving units between the first driving unit and the second driving unit are third driving units. The first driving unit and the second driving unit respectively include a first grounding pin. The third driving unit includes a first grounding pin and a second grounding pin. The first grounding pin of the first driving unit is electrically connected to the first grounding pin of the third driving unit adjacent thereto, and the first grounding pin of the second driving unit is electrically connected to the second grounding pin of the third driving unit adjacent thereto. The first grounding pin of each of other third driving units is electrically connected to the second grounding pin of the third driving unit adjacent thereto and located therebefore, and the second grounding pin of each of other third driving units is electrically connected to the first grounding pin of the third driving unit adjacent thereto and located thereafter. The above first grounding pin and the second grounding pin are respectively configured to be electrically connected to the peripheral ground line of the display panel. The above other third driving units are the third driving units of the driving units other than the third driving unit adjacent to the first driving unit and the third driving unit adjacent to the second driving unit.

For example, as shown in FIG. 2, the embodiments of the present disclosure provide five driving units, which include a driving unit 01, a driving unit 02, a driving unit 03, a driving unit 04, and a driving unit 05; and the driving unit 01, the driving unit 03, the driving unit 04, the driving unit 05, and the driving unit 02 are arranged in the target direction F. One of the driving unit 01 and the driving unit 02 is the first driving unit, and the other one is the second driving unit. The driving unit 03, the driving unit 04, and the driving unit 05 are all third driving units. The embodiments of the present disclosure take the driving unit 01 as the first driving unit and the driving unit 02 as the second driving unit as an example for description. The first driving unit 01 includes a first grounding pin 014, the second driving unit 02 includes a first grounding pin 024. The third driving unit 03 includes a first grounding pin 031 and a second grounding pin 032, the third driving unit 04 includes a first grounding pin 041 and a second grounding pin 042, and the third driving unit 05 includes a first grounding pin 051 and a second grounding pin 052. The first grounding pin 014 of the first driving unit 01 is electrically connected to the first grounding pin 031 of the third driving unit 03 adjacent thereto, the first grounding pin 024 of the second driving unit 02 is electrically connected to the second grounding pin 052 of the third driving unit 05 adjacent thereto. The first grounding pin 041 of the third driving unit 04 is electrically connected to the second grounding pin 032 of the third driving unit 03 adjacent thereto and located therebefore. The second grounding pin 042 of the third driving unit 04 is electrically connected to the first grounding pin 051 of the third driving unit 05 adjacent thereto and located thereafter. The first grounding pin 014, the first grounding pin 024, the first grounding pin 031, the second grounding pin 032, the first grounding pin 041, the second grounding pin 042, the first grounding pin 051, and the second grounding pin 052 are all configured to be electrically connected to the peripheral ground line of the display panel, and each grounding pin may lead the static electricity of the peripheral ground line to the ground terminal, so as to prevent the static electricity from damaging the display panel.

Optionally, the first driving unit and the second driving unit further respectively include a second grounding pin, and the third driving unit further includes a third grounding pin and a fourth grounding pin. The second grounding pin of the first driving unit is electrically connected to the third grounding pin of the third driving unit adjacent thereto, the second grounding pin of the second driving unit is electrically connected to the fourth grounding pin of the third driving unit adjacent thereto. The third grounding pin of each of other third driving units is electrically connected to the fourth grounding pin of the third driving unit adjacent thereto and located therebefore, and the fourth grounding pin of each of other third driving units is electrically connected to the third grounding pin of the third driving unit adjacent thereto and located thereafter. The above second grounding pin, third grounding pin, and fourth grounding pin are respectively configured to be electrically connected to the peripheral ground line of the display panel.

In an exemplary embodiment, with continue to refer to FIG. 2, the first driving unit 01 further includes a second grounding pin 015, the second driving unit 02 further includes a second grounding pin 025, the third driving unit 03 further includes a third grounding pin 033 and a fourth grounding pin 034, the third driving unit 04 further includes a third grounding pin 043 and a fourth grounding pin 044, and the third driving unit 05 further includes a third grounding pin 053 and a fourth grounding pin 054. The second grounding pin 015 of the first driving unit 01 is electrically connected to the third grounding pin 033 of the third driving unit 03 adjacent thereto, the second grounding pin 025 of the second driving unit 02 is electrically connected to the fourth grounding pin 054 of the third driving unit 05 adjacent thereto, the third grounding pin 043 of the third driving unit 04 is electrically connected to the fourth grounding pin 034 of the third driving unit 03 adjacent thereto and located therebefore, the fourth grounding pin 044 of the third driving unit 04 is electrically connected to the third grounding pin 053 of the third driving unit 05 adjacent thereto and located thereafter. The second grounding pin 015, the second grounding pin 025, the third grounding pin 033, the fourth grounding pin 034, the third grounding pin 043, the fourth grounding pin 044, the third grounding pin 053, and the fourth grounding pin 054 are all configured to be electrically connected to the peripheral ground line of the display panel, and each grounding pin may lead the static electricity of the peripheral ground line to the ground terminal, thereby preventing the static electricity from damaging the display panel.

Optionally, in the embodiments of the present disclosure, M=10, that is, at least one driving unit of the driving circuit includes 10 dummy pins. In this way, the driving circuit may be electrically connected to any display panel with the number of clock pins less than or equal to 10, that is, the driving circuit may be compatible with any display panel with the number of clock pins less than or equal to 10. For example, the driving circuit may be compatible with a display panel with 8 clock pins. Currently, the common display panels are 8CLK display panels or 6CLK display panels, and the number of clock pins thereof is less than 10. Therefore, the driving circuit may be compatible with all currently common display panels.

Figure 3:
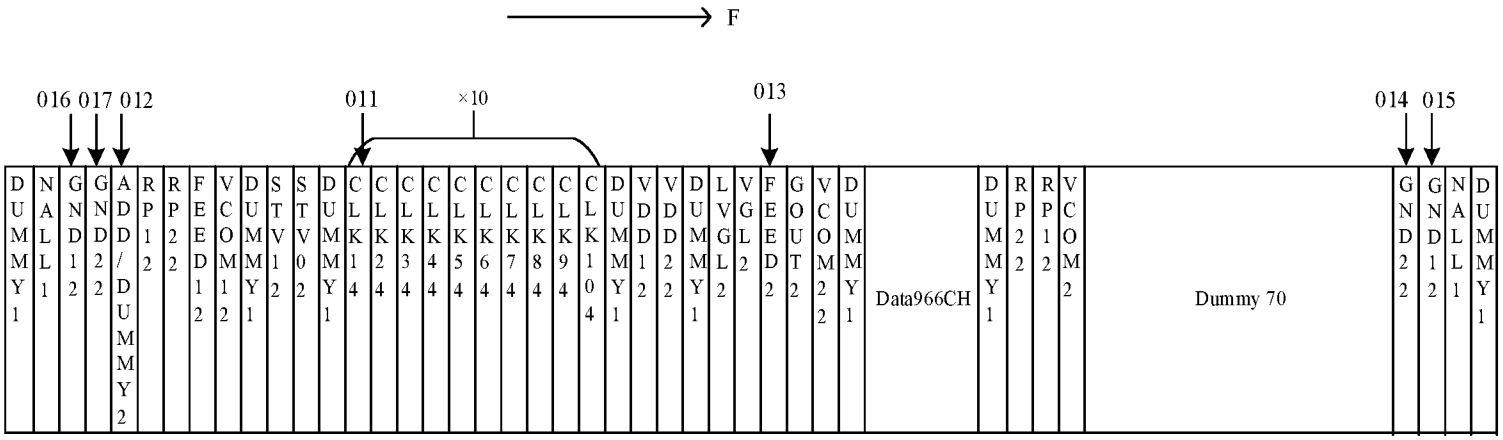
FIG. 3 is a schematic diagram of a first driving unit according to embodiments of the present disclosure.

In an exemplary embodiment, referring to FIG. 3, which shows a schematic diagram of a first driving unit 01 according to embodiments of the present disclosure, the first driving unit includes 10 dummy pins 011 (CLK14-CLK104, respectively). The third grounding pin 016, the fourth grounding pin 017, the test pin 012, the 10 dummy pins 011, the feed pin 013, the first grounding pin 014, and the second grounding pin 015 are arranged sequentially in the target direction F. As shown in FIG. 3, the first driving unit 01 further includes a data pin Data966CH located between the feed pin 013 and the first grounding pin 014. The data pin Data966CH may include 966 data pins which may be electrically connected to the data lines of the display panel and transmit data signals to the display panel. Optionally, when the first driving unit 01 is electrically connected to the display panel, 960 data pins in the data pin Data966CH may be electrically connected to the data lines of the display panel, and 6 data pins are floated, and the 6 floated data pins may be the first 6 or the last 6 data pins of the 966 data pins (that is, the first 6 or the last 6 data pins arranged in the target direction F), which is not limited in the embodiments of the present disclosure.

Figure 4:
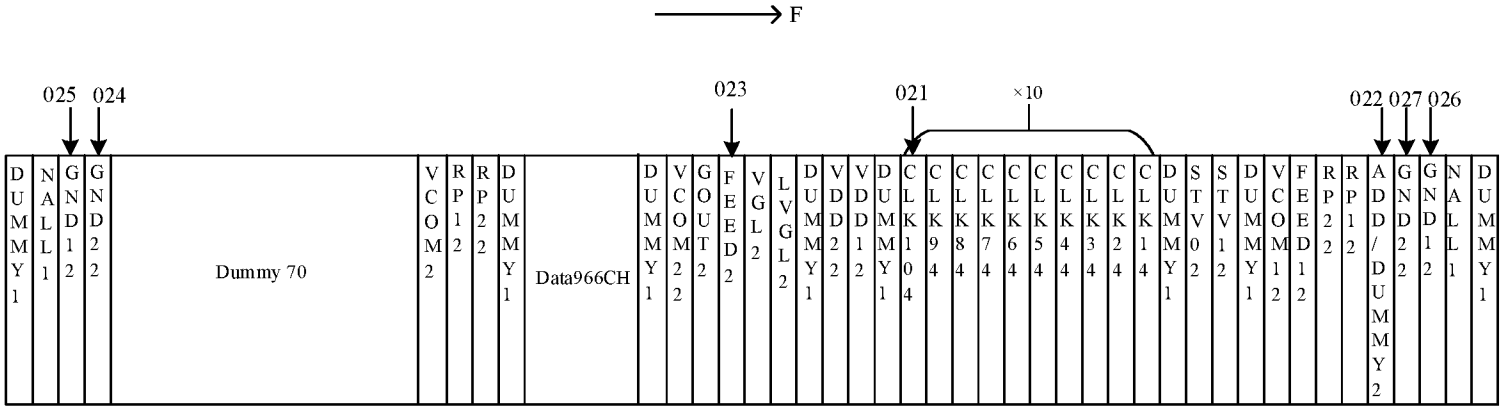
FIG. 4 is a schematic diagram of a second driving unit according to embodiments of the present disclosure.

In an exemplary embodiment, referring to FIG. 4, which shows a schematic diagram of a second driving unit 02 according to embodiments of the present disclosure, the second driving unit 02 includes 10 dummy pins 021 (CLK14-CLK104, respectively). The third grounding pin 026, the fourth grounding pin 027, the test pin 022, the 10 dummy pins 021, the feed pin 023, the first grounding pin 024, and the second grounding pin 025 are arranged sequentially in a direction opposite to the target direction F. As shown in FIG. 4, the second driving unit 02 also includes a data pin Data966CH located between the feed pin 023 and the first grounding pin 024. The data pin Data966CH may include 966 data pins which may be electrically connected to the data lines of the display panel and transmit data signals to the display panel. Optionally, when the second driving unit 02 is electrically connected to the display panel, 960 data pins in the data pin Data966CH may be electrically connected to the data lines of the display panel, and 6 data pins are floated. The 6 floated data pins may be the first 6 or the last 6 data pins of the 966 data pins (that is, the first 6 or the last 6 data pins arranged in the target direction F), which is not limited in the embodiments of the present disclosure.

Figure 5:
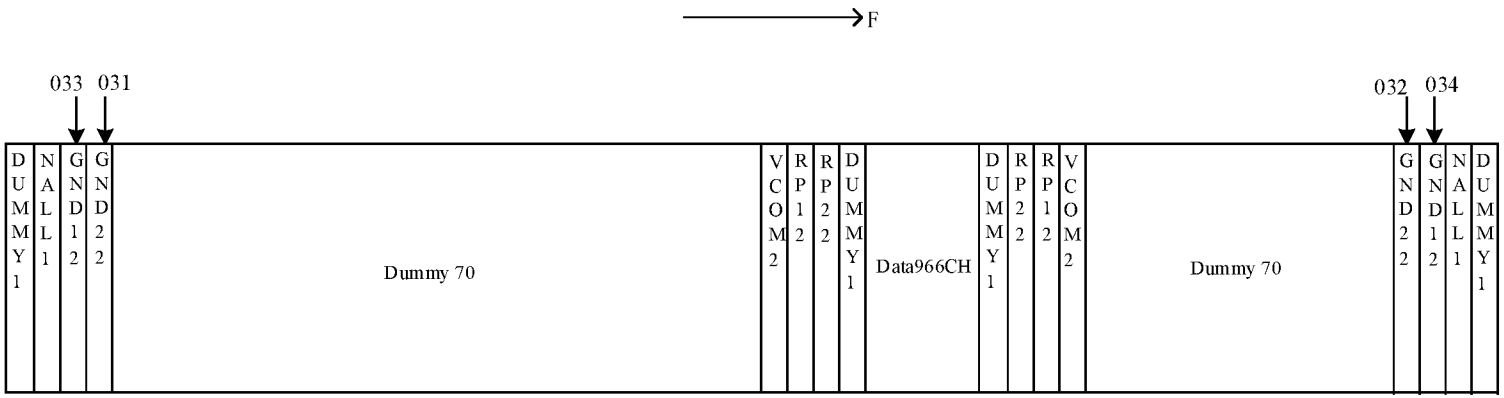
FIG. 5 is a schematic diagram of a third driving unit according to embodiments of the present disclosure.

In an exemplary embodiment, referring to FIG. 5, which shows a schematic diagram of a third driving unit according to embodiments of the present disclosure, FIG. 5 takes the third driving unit 03 as an example for description. The third driving unit 03 includes a first grounding pin 031, a second grounding pin 032, a third grounding pin 033, and a fourth grounding pin 034. The third grounding pin 033, the first grounding pin 031, the second grounding pin 032, and the fourth grounding pin 034 are arranged in the target direction F. As shown in FIG. 5, the third driving unit 03 also includes a data pin Data966CH located between the first grounding pin 031 and the second grounding pin 032. The data pin Data966CH may include 966 data pins which may be electrically connected to the data lines of the display panel and transmit data signals to the display panel. Optionally, when the third driving unit 03 is electrically connected to the display panel, 960 data pins of the data pin Data966CH may be electrically connected to the data lines of the display panel, and 6 data pins are floated. The 6 floated data pins are the first 6 or the last 6 data pins of the 966 data pins (that is, the first 6 or the last 6 data pins arranged in the target direction F), which is not limited in the embodiments of the present disclosure.

Optionally, with reference to FIGS. 2 to 5, in the embodiments of the present disclosure, the third driving units are located between the first driving unit 01 and the second driving unit 02, and the first driving unit 01 and the second driving unit 02 are symmetrical with respect to the third driving units. The third grounding pin 016, the fourth grounding pin 017, the test pin 012, the 10 dummy pins 011, the feed pin 013, the first grounding pin 014, and the second grounding pin 015 are arranged sequentially in the target direction F. That is, the third grounding pin 016, the fourth grounding pin 017, the test pin 012, the 10 dummy pins 011, the feed pin 013, the first grounding pin 014, and the second grounding pin 015 are arranged sequentially in a direction of approaching the second driving unit 02. The third grounding pin 026, the fourth grounding pin 027, the test pin 022, the 10 dummy pins 021, the feed pin 023, the first grounding pin 024, and the second grounding pin 025 are arranged sequentially in a direction opposite to the target direction F. That is, the third grounding pin 026, the fourth grounding pin 027, the test pin 022, the 10 dummy pins 021, the feed pin 023, the first grounding pin 024, and the second grounding pin 025 are arranged sequentially in a direction of approaching the first driving unit 01. The third grounding pin 033, the first grounding pin 031, the second grounding pin 032, and the fourth grounding pin 034 are arranged sequentially in the target direction F. That is, the third grounding pin 033, the first grounding pin 031, the second grounding pin 032, and the fourth grounding pin 034 are arranged sequentially in a direction from close to the first driving unit 01 to close to the second driving unit 02.

In the embodiments of the present disclosure, as described above, each of the driving units may include a plurality of pins, the width of each pin is 16 to 18 microns, and the spacing between any two adjacent pins may be 16 to 18 microns. For example, the width of each pin may be 17 microns, and the spacing between any two adjacent pins may be 17 microns, which is not limited in the embodiments of the present disclosure.

Optionally, in the embodiments of the present disclosure, the driving circuit may be a COF circuit. The COF circuit is a circuit formed based on COF technology. COF technology refers to the grain soft film packaging technology that fixes the drive chip on the flexible circuit board. In the COF technology, the flexible circuit board may be used as the carrier of the drive chip. The drive chip is electrically connected to the display panel through the flexible circuit board.

Optionally, before the COF circuit is electrically connected to the display panel, the COF circuit board may be cut according to the width of the pins and distance between the pins of the COF circuit, so that the pins of the COF circuit may be electrically connected to the pins of the display panel. For example, the number of pins of the COF circuit electrically connected to the pins of the display panel may be 1024, the width of each pin may be 17 microns, the distance between any two adjacent pins is 17 microns, and the accuracy fluctuation of cutting may be 5 microns, whereby the cutting size of the COF circuit board (that is, the size of the COF circuit board formed by cutting) may be driven.

Optionally, in the process of electrically connecting the COF circuit with the display panel, the pins of the COF circuit may be aligned with the pins of the display panel. For example, alignment marks may be provided in the display panel and the COF circuit board, and the pins of the display panel and the pins of the COF circuit are aligned according to the alignment marks.

Optionally, in the process of electrically connecting the COF circuit and the display panel, heating is usually needed (for example, heat is generated in the soldering process of the pins of the display panel and the pins of the COF circuit), and the heating process is likely to cause the COF circuit board to expand, which causes the pins of the COF circuit to offset. As a result, the pins of the COF circuit and the pins of the display panel are likely to misalignment, resulting in low reliability of electrical connection between the COF circuit and the display panel. In the embodiments of the present disclosure, the expansion pre-shrinkage value can be set for the pins of the COF circuit to avoid the misalignment of the pins of the COF circuit and the pins of the display panel due to the expansion of the COF circuit, and improve the reliability of the electrical connection between the COF circuit and the display panel.

In summary, in the driving circuit for the display panel according to the present disclosure, at least one of the driving units of the driving circuit includes M dummy pins, and at least one of the M dummy pins is configured to be electrically connected to at least one clock pin of the display panel. Therefore, the driving circuit may be electrically connected to any display panel with the number of clock pins less than or equal to M, and the driving circuit may be compatible with any display panel with the number of clock pins less than M, which helps to improve the compatibility of the driving circuit.

Figure 6:
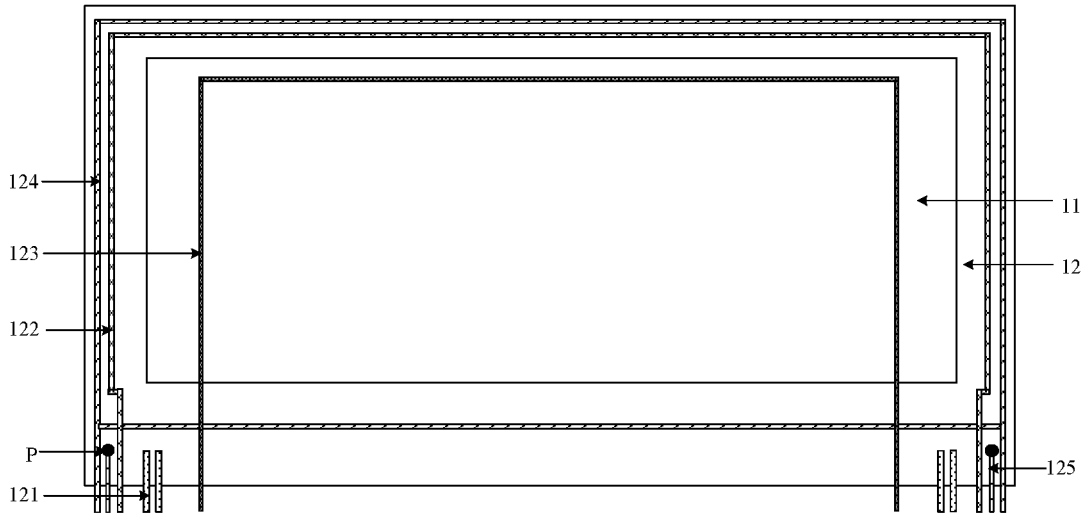
FIG. 6 is a schematic diagram of a display panel according to embodiments of the present disclosure.

Referring to FIG. 6, which shows a schematic diagram of a display panel according to embodiments of the present disclosure, the display panel includes at least one clock pin 121. The at least one clock pin 121 is configured to be electrically connected to at least one of the M dummy pins (not shown in FIG. 6) of at least one driving unit of the driving circuit (not shown in FIG. 6) for the display panel, and M is an integer greater than or equal to 1. The driving circuit may be the driving circuit shown in FIG. 1 or FIG. 2.

In summary, the display panel according to the present disclosure includes at least one clock pin which is configured to be electrically connected to at least one of the M dummy pins of at least one driving unit of the driving circuit. Therefore, the driving circuit with M dummy pins may be electrically connected to any display panel with the number of clock pins less than or equal to M, and the driving circuit may be compatible with any display panel with the number of clock pins less than M, which helps improve the compatibility of the driving circuit.

Optionally, with continue to refer to FIG. 6, the display panel has a display area 11 and a non-display area 12. The display panel further includes a test line 122 located in the non-display area 12. The test line 122 is configured to be electrically connected to a test pin in at least one driving unit of the driving circuit. The test line is configured to receive the test signal transmitted by the test pin during the test phase of the display panel, and to be grounded through the test pin during the display stage of the display panel.

The test line 122 of the display panel according to the embodiments of the disclosure may be an AT line, and the test line is generally electrically connected to the AT circuit of the display panel motherboard. The display panel motherboard includes a plurality of display panels. The test line is located inside the display panel, and the AT circuit is located outside the display panel. The AT circuit is configured to test the display panel by transmitting a test signal to the display panel through the test line. After the test is completed, the display panel motherboard is generally cut into individual display panels. In the process of cutting, the test line electrically connected to the AT circuit is also cut off, thereby forming a fracture of the test line in the final individual display panel. The fracture is easy to cause static electricity, which is easy to affect or even destroy (for example, breakdown) the display panel. In the embodiments of the present disclosure, since the test line is electrically connected to the test pin of the driving circuit, after the test is completed, the test line may be grounded through the test pin, thereby preventing static electricity from damaging the display panel.

Optionally, with continue to refer to FIG. 6, the display panel further includes a common electrode line 123 located in the display area 11. The common electrode line 123 is configured to be electrically connected to the feed pin in at least one driving unit of the driving circuit. The common electrode line 123 is configured to receive a feed signal or a compensation signal transmitted by the feed pin, the compensation signal may be a common electrode signal.

Optionally, with continue to refer to FIG. 6, the display panel further includes a peripheral ground line 124 and silver glue dots P. The peripheral ground line 124 is located in the non-display area 12 at the periphery of the display area 11, and located at a side of the test line 122 away from the display area 11, and the silver glue dots P are located in the non-display area 12. The driving circuit includes a plurality of driving units arranged in a target direction. The driving units at two ends of the driving units are respectively a first driving unit and a second driving unit, and the driving units between the first driving unit and the second driving unit are third driving units. The first driving unit and the second driving unit respectively include M dummy pins, a test pin, and a feed pin. The first driving unit, the second driving unit, and the third driving unit respectively include a first grounding pin, a second grounding pin, a third grounding pin, and a fourth grounding pin. The silver glue dots P are configured to be electrically connected to the fourth grounding pins of the first driving unit and the second driving unit through the silver glue dot ground lines 125, and the peripheral ground line 124 is configured to be electrically connected to the grounding pins of the driving circuit other than the fourth grounding pins of the first driving unit and the second driving unit. The grounding pins ground the peripheral ground line 124 and the ground lines for the silver glue dots P, which can prevent static electricity from damaging the display panel.

In summary, the display panel according to the present disclosure includes at least one clock pin configured to be electrically connected to at least one of the M dummy pins of at least one driving unit of the driving circuit. Therefore, the driving circuit with M dummy pins may be electrically connected to any display panel with the number of clock pins less than or equal to M, that is, the driving circuit may be compatible with any display panel with the number of clock pins less than M, which helps to improve the compatibility of the driving circuit.

Figure 7:
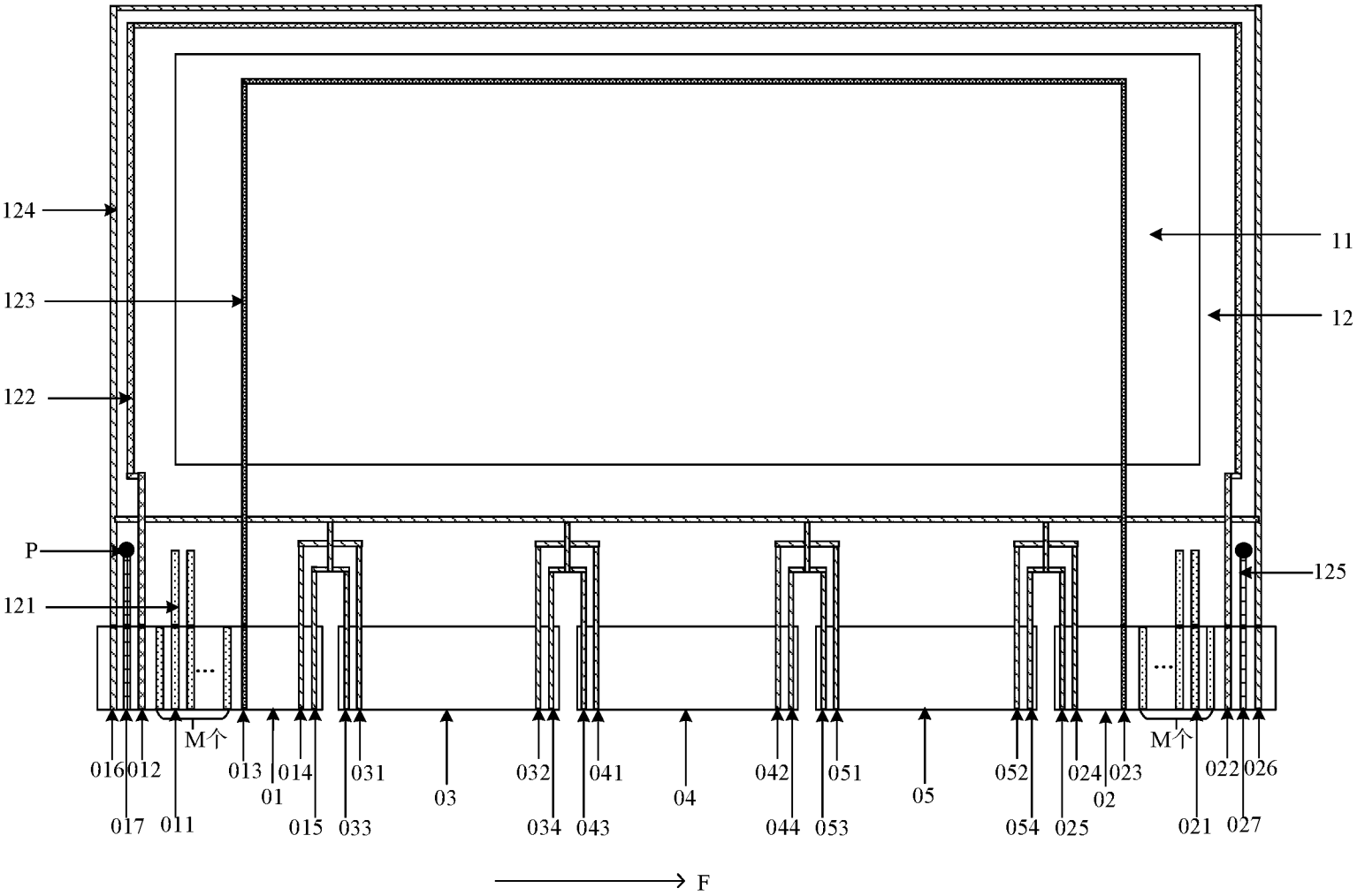
FIG. 7 is a schematic diagram of a display device according to embodiments of the present disclosure.

Referring to FIG. 7, which shows a schematic diagram of a display device according to embodiments of the present disclosure, the display device may include a display panel and a driving circuit, and the driving circuit is located on at least one side of the display panel. The display panel may be the display panel shown in FIG. 6, and the driving circuit may be the driving circuit shown in FIG. 1 or FIG. 2. The display panel includes at least one clock pin 121, the driving circuit includes a plurality of driving units, at least one of the driving units includes M dummy pins, M is an integer greater than or equal to 1, and at least one of the M dummy pins is electrically connected to at least one clock pin 121 of the display panel. For example, referring to FIG. 7 in conjunction with FIG. 1 or FIG. 2, the driving unit 01 includes M dummy pins 011, the driving unit 02 includes M dummy pins 021. At least one of the M dummy pins 011 is electrically connected to at least one clock pin of the display panel, and at least one of the M dummy pins 021 is electrically connected to at least one clock pin of the display panel.

In summary, the display device according to the present disclosure includes a display panel and a driving circuit, the driving circuit is located on at least one side of the display panel, and at least one of a plurality of driving units of the driving circuit includes M dummy pins, at least one of the M dummy pins is electrically connected to at least one clock pin of the display panel. Therefore, the driving circuit may be electrically connected to any display panel with the number of clock pins less than or equal to M, and the driving circuit may be compatible with any display panel with the number of clock pins less than M, which helps to improve the compatibility of the driving circuit.

Optionally, with continue to refer to FIG. 7, the display panel has a display area 11 and a non-display area 12. The display panel further includes a test line 122, and the test line 122 is located in the non-display area 12. At least one of the driving units further includes a test pin that is electrically connected to the test line 122, and the test pin is configured to transmit a test signal to the test line 122 during the test phase of the display panel, and to ground the test line 122 during the display phase of the display panel. For example, referring to FIG. 7 in conjunction with FIG. 1 or FIG. 2, the driving unit 01 includes a test pin 012, and the driving unit 02 includes a test pin 022. The test pin 012 and the test pin 022 are both electrically connected to the test line 122. The test pin 012 and the test pin 022 are both configured to transmit a test signal to the test line 122 during the test phase of the display panel, and to ground the test line 122 during the display phase of the display panel.

The test line of the display panel described in the embodiments of the disclosure may be AT line, and the test line is generally electrically connected to the AT circuit of the display panel motherboard. The display panel motherboard includes a plurality of display panels. The test line is located inside the display panel, and the AT circuit is located outside the display panel. The AT circuit is configured to test the display panel by transmitting a test signal to the display panel through the test line. After the test is completed, the display panel motherboard is generally cut into individual display panels. In the process of cutting, the test line electrically connected to the AT circuit is also cut off, thereby forming a fracture of the test line in the final individual display panel. The fracture is easy to cause static electricity, which is easy to affect or even destroy (for example, breakdown) the display panel. In the embodiments of the present disclosure, since the test line is electrically connected to the test pin, after the test is completed, the test line may be grounded through the test pin, thereby preventing static electricity from damaging the display panel.

Optionally, with continue to refer to FIG. 7, the display panel further includes a common electrode line 123 located in the display area 11. At least one of the driving units further includes a feed pin electrically connected to the common electrode line 123. The feed pin is configured to transmit a feed signal or a compensation signal to the common electrode line 123, the compensation signal may be a common electrode signal. For example, referring to FIG. 7 in conjunction with FIG. 1 and FIG. 2, the driving unit 01 includes a feed pin 013, and the driving unit 02 includes a feed pin 023. The feed pin 013 and the feed pin 023 are respectively electrically connected to the common electrode line 123, and the feed pin 013 and the feed pin 023 are configured to transmit a feed signal or a compensation signal to the common electrode line 123.

Optionally, in the driving circuit according to the embodiments of the present disclosure, a plurality of driving units are arranged in the target direction F, and the driving units respectively include grounding pins, and at least one grounding pin of one of any two adjacent driving units is electrically connected to at least one grounding pin of the other driving unit. With continue to refer to FIG. 7, the display panel may be a rectangular panel, the driving units may be located on the same side of the display panel and arranged along the same side edge of the display panel, and the target direction may be parallel to the side edge. In the embodiments of the present disclosure, since at least one grounding pin of one of any two adjacent driving units in the driving units is electrically connected to at least one grounding pin of the other driving unit, the influence of static electricity on the drive signal of an individual driving unit can be reduced, so that the transmission of the drive signal is more stable.

Optionally, with continue to refer to FIG. 7, the display panel further includes a peripheral ground line 124, the peripheral ground line 124 is located in the non-display area 12 at the periphery of the display area 11 and is located at one side of the test line 122 away from the display area 11. In the driving circuit according to the embodiments of the present disclosure, the driving units at two ends of the driving units are respectively the first driving unit and the second driving unit, and the driving units between the first driving unit and the second driving unit are third driving units. The first driving unit and the second driving unit respectively include M dummy pins and a first grounding pin. The third driving unit includes a first grounding pin and a second grounding pin. The first grounding pin of the first driving unit is electrically connected to the first grounding pin of the third driving unit adjacent thereto, and the first grounding pin of the second driving unit is electrically connected to the second grounding pin of the third driving unit adjacent thereto. The first grounding pin of each of other third driving units is electrically connected to the second grounding pin of the third driving unit adjacent thereto and located therebefore, and the second grounding pin of each of other third driving units is electrically connected to the first grounding pin of the third driving unit adjacent thereto and located thereafter. The first grounding pins and the second grounding pins are electrically connected to the peripheral ground line, respectively. The above other third driving units are third driving units other than the third driving unit adjacent to the first driving unit and the third driving unit adjacent to the second driving unit.

For example, referring to FIG. 7 in conjunction with FIG. 2, the embodiments of the present disclosure take the driving circuit including 5 driving units, and the 5 driving units including the driving unit 01, the driving unit 03, the driving unit 04, the driving unit 05, and the driving unit 02 arranged in the target direction F as an example for description. One of the driving unit 01 and the driving unit 02 is the first driving unit, and the other of the driving unit 01 and the driving unit 02 is the second driving unit. The driving unit 03, the driving unit 04, and the driving unit 05 are all third driving units. The embodiments of the present disclosure take the driving unit 01 as the first driving unit and the driving unit 02 as the second driving unit as an example for description. The first driving unit 01 includes a first grounding pin 014, the second driving unit 02 includes a first grounding pin 024. The third driving unit 03 includes a first grounding pin 031 and a second grounding pin 032. The third driving unit 04 includes a first grounding pin 041 and a second grounding pin 042. The third driving unit 05 includes a first grounding pin 051 and a second grounding pin 052. The first grounding pin 014 of the first driving unit 01 is electrically connected to the first grounding pin 031 of the third driving unit 03 adjacent thereto, and the first grounding pin 024 of the second driving unit 02 is electrically connected to the second grounding pin 052 of the third driving unit 05 adjacent thereto. The first grounding pin 041 of the third driving unit 04 is electrically connected to the second grounding pin 032 of the third driving unit 03 adjacent thereto and located therebefore. The second grounding pin 042 of the third driving unit 04 is electrically connected to the first grounding pin 051 of the third driving unit 05 adjacent thereto and located thereafter. The first grounding pin 014, the first grounding pin 024, the first grounding pin 031, the second grounding pin 032, the first grounding pin 041, the second grounding pin 042, the first grounding pin 051, and the second grounding pin 052 are all electrically connected to the peripheral ground line 124, and each grounding pin may lead the static electricity of the peripheral ground line 124 to the ground terminal, so as to prevent the static electricity from damaging the display panel.

Optionally, the first driving unit and the second driving unit further respectively include a second grounding pin, and the third driving unit further includes a third grounding pin and a fourth grounding pin. The second grounding pin of the first driving unit is electrically connected to the third grounding pin of the third driving unit adjacent thereto, the second grounding pin of the second driving unit is electrically connected to the fourth grounding pin of the third driving unit adjacent thereto, and the third grounding pin of each of other third driving units is electrically connected to the fourth grounding pin of the third driving unit adjacent thereto and located therebefore, and the fourth grounding pin is electrically connected to the third grounding pin of the third driving unit adjacent thereto and located thereafter. The above second grounding pin, third grounding pin, and fourth grounding pin are respectively electrically connected to the peripheral ground line.

For example, referring to FIG. 7 in conjunction with FIG. 2, the first driving unit 01 further includes a second grounding pin 015, the second driving unit 02 further includes a second grounding pin 025, the third driving unit 03 further includes a third grounding pins 033 and a fourth grounding pin 034, the third driving unit 04 further includes a third grounding pin 043 and a fourth grounding pin 044, and the third driving unit 05 further includes a third grounding pin 053 and a fourth grounding pin 054. The second grounding pin 015 of the first driving unit 01 is electrically connected to the third grounding pin 033 of the third driving unit 03 adjacent thereto, the second grounding pin 025 of the second driving unit 02 is electrically connected to the fourth grounding pin 054 of the third driving unit 05 adjacent thereto, the third grounding pin 043 of the third driving unit 04 is electrically connected to the fourth grounding pin 034 of the third driving unit 03 adjacent thereto and located therebefore, the fourth grounding pin 044 of the third driving unit 04 is electrically connected to the third grounding pin 053 of the third driving unit 05 adjacent thereto and located thereafter. The second grounding pin 015, the second grounding pin 025, the third grounding pin 033, the fourth grounding pin 034, the third grounding pin 043, the fourth grounding pin 044, the third grounding pin 053, and the fourth grounding pin 054 are all electrically connected to the peripheral ground line 124 of the display panel, and each grounding pin may lead the static electricity of the peripheral ground line to the ground terminal, thereby preventing the static electricity from damaging the display panel.

Optionally, with continue to refer to FIG. 7, the display panel further includes silver glue dots P located in the non-display area 12. At least one of the first driving unit and the second driving unit further includes a third grounding pin and a fourth grounding pin. The third grounding pin is electrically connected to the peripheral ground line 124, and the fourth grounding pin is electrically connected to the silver glue dot P of the display panel through the gluing spot ground line 125, so that the grounding pins may ground the peripheral ground line 124 and the silver glue dot ground line 125, thereby preventing static electricity from damaging the display panel.

For example, referring to FIG. 7 in conjunction with FIG. 2, the first driving unit 01 further respectively includes a third grounding pin 016 and a fourth grounding pin 017, and the second driving unit 02 further includes a third grounding pin 026 and a fourth grounding pin 027. The third grounding pin 016 and the third grounding pin 026 are electrically connected to the peripheral ground line 124 of the display panel, the fourth grounding pin 017 and the fourth grounding pin 027 are electrically connected to the silver glue dots P of the display panel through the silver glue dot ground lines 125, so that the grounding pins may ground the peripheral ground line 124 and the silver glue dot ground lines 125, thereby prevent static electricity from damaging the display panel. For example, the third grounding pin 016 of the first driving unit 01 and the third grounding pin 026 of the second driving unit 02 are electrically connected to both ends of the peripheral ground line 124, and the fourth grounding pin 017 of the first driving unit 01 and the fourth grounding pin 027 of the second driving unit 02 are electrically connected to two silver glue dots P of the display panel through two silver glue dot ground lines 125.

Optionally, in the embodiments of the present disclosure, M=10, that is, at least one driving unit of the driving circuit includes 10 dummy pins. In this way, the driving circuit may be electrically connected to any display panel with the number of clock pins less than or equal to 10, that is, the driving circuit may be compatible with any display panel with the number of clock pins less than or equal to 10. For example, the driving circuit may be compatible with a display panel with 8 clock pins. Currently common display panels are 8CLK display panels or 6CLK display panels, and the number of clock pins thereof is less than 10. Therefore, the driving circuit can be compatible with all currently common display panels.

Optionally, referring to FIG. 2 to FIG. 7, in the embodiments of the present disclosure, the third driving units are located between the first driving unit 01 and the second driving unit 02, and the first driving unit 01 and the second driving unit 02 are symmetrical about the third driving units. In the first driving unit 01: the third grounding pin 016, the fourth grounding pin 017, the test pin 012, the 10 dummy pins 011, the feed pin 013, the first grounding pin 014, and the second grounding pin 015 are arranged sequentially in the direction of approaching the second driving unit 02. In the second driving unit 02: the third grounding pin 026, the fourth grounding pin 027, the test pin 022, the 10 dummy pins 021, the feed pin 023, the first grounding pin 024, and the second grounding pin 025 are arranged sequentially in the direction of approaching the first driving unit 01. In the third driving unit 03: the third grounding pin 033, the first grounding pin 031, the second grounding pin 032, and the fourth grounding pin 034 are arranged sequentially in the direction from close to the first driving unit 01 to close to the second driving unit 02. In the third driving unit 04: the third grounding pin 043, the first grounding pin 041, the second grounding pin 042, and the fourth grounding pin 044 are arranged sequentially in the direction from close to the first driving unit 01 to close to the second driving unit 02. In the third driving unit 05: the third grounding pin 053, the first grounding pin 051, the second grounding pin 052, and the fourth grounding pin 054 are arranged sequentially in the direction from close to the first driving unit 01 to close to the second driving unit 02.

In summary, the display device according to the present disclosure includes a display panel and a driving circuit, the driving circuit is located on at least one side of the display panel. At least one of the driving units of the driving circuit includes M dummy pins, at least one of the M dummy pins is electrically connected to at least one clock pin of the display panel. Therefore, the driving circuit may be electrically connected to any display panel with the number of clock pins less than or equal to M, that is, the driving circuit may be compatible with any display panel with the number of clock pins less than M, which helps to improve the compatibility of the driving circuit.

In the present disclosure, the terms "first", "second", "third", "fourth" and other similar descriptions are only used for descriptive purposes, and cannot be understood as indicating or implying relative importance. The term "at least one" refers to one or more, and the term "a plurality of" refers to two or more, unless otherwise expressly defined. The term "and/or" is merely an association relationship that describes the associated objects, indicating that there may be three relationships; for example, A and/or B may indicate three cases where only A exists, A and B exist at the same time, and only B exists. In addition, the character "/" herein generally indicates that the associated objects before and after are in an "or" relationship.

The above are only optional embodiments of the present disclosure and are not intended to limit the present disclosure. Any modification, equivalent replacement, improvement and the like made within the concept and principle of the present disclosure shall be included within the protection scope of the present disclosure.

What is claimed is:

1. A driving circuit for a display panel, comprising:

a plurality of driving units, wherein at least one of the driving units comprises M dummy pins, at least one of the M dummy pins is configured to be electrically connected to at least one clock pin of the display panel, and M is an integer greater than or equal to 1; wherein driving units at two ends of the driving units are respectively a first driving unit and a second driving unit, driving units between the first driving unit and the second driving unit are third driving units, the first driving unit and the second driving unit respectively comprise the M dummy pins and a first grounding pin, and each of the third driving units comprises a first grounding pin and a second grounding pin.

2. The driving circuit according to claim 1, wherein at least one of the driving units further comprises a test pin, wherein the test pin is configured to be electrically connected to a test line of the display panel, transmit a test signal to the test line during a test phase of the display panel and ground the test line during a display phase of the display panel; and at least one of the driving units further comprises a feed pin, wherein the feed pin is configured to be electrically connected to a common electrode line of the display panel and transmit one of a feed signal and a compensation signal to the common electrode line.

3. The driving circuit according to claim 1, wherein the driving units are arranged in a target direction.

4. The driving circuit according to claim 3, wherein the first grounding pin of the first driving unit is electrically connected to the first grounding pin of a third driving unit adjacent thereto, the first grounding pin of the second driving unit is electrically connected to the second grounding pin of a third driving unit adjacent thereto, the first grounding pin of any of other third driving units is electrically connected to the second grounding pin of a third driving unit adjacent thereto and located therebefore, and the second grounding pin of any of other third driving units is electrically connected to the first grounding pin of a third driving unit adjacent thereto and located thereafter, wherein the other third driving units are third driving units other than the third driving unit adjacent to the first driving unit and the third driving unit adjacent to the second driving unit; and the first grounding pins and the second grounding pins are respectively configured to be electrically connected to a peripheral ground line of the display panel.

5. The driving circuit according to claim 4, wherein the first driving unit and the second driving unit further respectively comprise a second grounding pin, and each of the third driving units further comprises a third grounding pin and a fourth grounding pin;

the second grounding pin of the first driving unit is electrically connected to the third grounding pin of a third driving unit adjacent thereto, the second grounding pin of the second driving unit is electrically connected to the fourth grounding pin of a third driving unit adjacent thereto, and the third grounding pin of each of the other third driving units is electrically connected to the fourth grounding pin of a third driving unit adjacent thereto and located therebefore, and the fourth grounding pin is electrically connected to the third grounding pin of a third driving unit adjacent thereto and located thereafter; and the second grounding pin, the third grounding pin, and the fourth grounding pin are respectively configured to be electrically connected to the peripheral ground line of the display panel.

6. The driving circuit according to claim 4, wherein at least one of the first driving unit and the second driving unit further comprises a third grounding pin and a fourth grounding pin;

the third grounding pin is configured to be electrically connected to the peripheral ground line of the display panel; and each of the fourth grounding pin of the first driving unit and the fourth grounding pin of the second driving unit is configured to be electrically connected to a silver glue dot of the display panel through a silver glue dot ground line.

7. The driving circuit according to claim 1, wherein the driving units are arranged in a target direction; the first driving unit and the second driving unit further respectively comprise a test pin, a feed pin, a second grounding pin, a third grounding pin, and a fourth grounding pin; each of the third driving units further comprises a third grounding pin and a fourth grounding pin;

in the first driving unit: the third grounding pin, the fourth grounding pin, the test pin, the M dummy pins, the feed pin, the first grounding pin, and the second grounding pin are arranged sequentially in a direction of approaching the second driving unit;

in the second driving unit: the third grounding pin, the fourth grounding pin, the test pin, the M dummy pins, the feed pin, the first grounding pin and the second grounding pin are arranged sequentially in a direction of approaching the first driving unit;

in the third driving unit: the third grounding pin, the first grounding pin, the second grounding pin, and the fourth grounding pin are arranged sequentially in a direction from the first driving unit to the second driving unit;

the first grounding pin of the first driving unit is electrically connected to the first grounding pin of a third driving unit adjacent thereto, and the second grounding pin of the first driving unit is electrically connected to the third grounding pin of the third driving unit adjacent thereto;

the first grounding pin of the second driving unit is electrically connected to the second grounding pin of a third driving unit adjacent thereto, and the second grounding pin of the second driving unit is electrically connected to the fourth grounding pin of the third driving unit adjacent thereto;

the first grounding pin of any of other third driving units is electrically connected to the second grounding pin of a third driving unit adjacent thereto and located therebefore, the second grounding pin of any of other third driving units is electrically connected to the first grounding pin of a third driving unit adjacent thereto and located thereafter, the third grounding pin of any of other third driving units is electrically connected to the fourth grounding pin of a third driving unit adjacent thereto and located therebefore, and the fourth grounding pin of any of other third driving units is electrically connected to the third grounding pin of a third driving unit adjacent thereto and located thereafter, wherein the other third driving units are third driving units other than the third driving unit adjacent to the first driving unit and the third driving unit adjacent to the second driving unit;

the test pins are configured to be electrically connected to a test line of the display panel, transmit test signals to the test line during a test phase of the display panel and ground the test line during a display phase of the display panel;

the feed pin is configured to be electrically connected to a common electrode line of the display panel and transmit one of a feed signal and a compensation signal to the common electrode line; and each of the fourth grounding pin of the first driving unit and the fourth grounding pin of the second driving unit is configured to be electrically connected to a silver glue dot of the display panel through a silver glue dot ground line, and grounding pins other than the fourth grounding pin of the first driving unit and the fourth grounding pin of the second driving unit are configured to be electrically connected to a peripheral ground line of the display panel.

8. The driving circuit according to claim 1, wherein at least one of the driving units comprises ten dummy pins;

each of the driving units comprises a plurality of pins, a width of the pin is 16 to 18 microns, and a spacing between any two adjacent pins is 16 to 18 microns; and the driving circuit is a chip-on-film circuit.

9. A display panel comprising:

at least one clock pin, wherein the at least one clock pin is configured to be electrically connected to at least one of M dummy pins of at least one driving unit of a driving circuit for the display panel, and M is an integer greater than or equal to 1; wherein the driving circuit comprises a plurality of driving units, driving units at two ends of driving units are respectively a first driving unit and a second driving unit, driving units between the first driving unit and the second driving unit are third driving units, the first driving unit and the second driving unit respectively comprise the M dummy pins and a first grounding pin, and each of the third driving units comprises a first grounding pin and a second grounding pin.

10. The display panel according to claim 9, wherein the display panel has a display area and a non-display area, and the display panel further comprises:

a test line located in the non-display area, and a common electrode line located in the display area;

wherein the test line is configured to be electrically connected to a test pin in at least one driving unit of the driving circuit, to receive a test signal transmitted by the test pin during a test phase of the display panel and to be grounded through the test pin during a display phase of the display panel; and the common electrode line is configured to be electrically connected to a feed pin in at least one driving unit of the driving circuit, to receive one of a feed signal and a compensation signal transmitted by the feed pin.

11. The display panel according to claim 10, wherein the display panel further comprises a peripheral ground line located in the non-display area at the periphery of the display area and located on a side of the test line away from the display area;

the driving circuit comprises a plurality of driving units arranged in a target direction; the first driving unit and the second driving unit further respectively comprise the test pin, the feed pin, a second grounding pin and a third grounding pin; each of the third driving units further comprises a third grounding pin and a fourth grounding pin; and the peripheral ground line is configured to be electrically connected to the first, second, third, and fourth grounding pins.

12. The display panel according to claim 11, wherein the display panel further comprises silver glue dots located in the non-display area;

the first driving unit and the second driving unit further respectively comprise a fourth grounding pin;

the silver glue dots are configured to be electrically connected to the fourth grounding pin of the first driving unit and the fourth grounding pin of the second driving unit through silver glue dot ground lines.

13. A display device, comprising:

a display panel and a driving circuit, wherein the driving circuit is located on at least one side of the display panel;

the display panel comprises at least one clock pin;

the driving circuit comprises a plurality of driving units, at least one of the driving units comprises M dummy pins, and M is an integer greater than or equal to 1; and at least one of the M dummy pins is electrically connected to the at least one clock pin; wherein driving units at two ends of the driving units are respectively a first driving unit and a second driving unit, driving units between the first driving unit and the second driving unit are third driving units, the first driving unit and the second driving unit respectively comprise the M dummy pins and a first grounding pin, and each of the third driving units comprises a first grounding pin and a second grounding pin.

14. The display device according to claim 13, wherein the display panel has a display area and a non-display area, the display panel further comprises a test line located in the non-display area and a common electrode line located in the display area;

at least one of the driving units further comprises a test pin and a feed pin, the test pin is electrically connected to the test line, and the feed pin is electrically connected to the common electrode line;

wherein the test pin is configured to transmit a test signal to the test line during a test phase of the display panel, and to ground the test line during a display phase of the display panel, the feed pin is configured to transmit one of a feed signal and a compensation signal to the common electrode line.

15. The display device according to claim 14, wherein the driving units are arranged in a target direction.

16. The display device according to claim 15, wherein the display panel further comprises a peripheral ground line located in the non-display area at the periphery of the display area and located on a side of the test line away from the display area;

the first grounding pin of the first driving unit is electrically connected to the first grounding pin of a third driving unit adjacent thereto, the first grounding pin of the second driving unit is electrically connected to the second grounding pin of a third driving unit adjacent thereto; the first grounding pin of any of other third driving units is electrically connected to the second grounding pin of a third driving unit adjacent thereto and located therebefore, the second grounding pin of any of other third driving units is electrically connected to the first grounding pin of a third driving unit adjacent thereto and located thereafter, wherein the other third driving units are third driving units other than the third driving unit adjacent to the first driving unit and the third driving unit adjacent to the second driving unit; and the first grounding pins and the second grounding pins are electrically connected to the peripheral ground line, respectively.

17. The display device according to claim 16, wherein the first driving unit and the second driving unit further respectively comprise a second grounding pin, and each of the third driving units further comprises a third grounding pin and a fourth grounding pin;

the second grounding pin of the first driving unit is electrically connected to the third grounding pin of a third driving unit adjacent thereto, the second grounding pin of the second driving unit is electrically connected to the fourth grounding pin of a third driving unit adjacent thereto, the third grounding pin of each of the other third driving units is electrically connected to the fourth grounding pin of a third driving unit adjacent thereto and located therebefore, and the fourth grounding pin of each of the other third driving units is electrically connected to the third grounding pin of a third driving unit adjacent thereto and located thereafter; and the second ground pins, the third ground pins, and the fourth ground pins are electrically connected to the peripheral ground line, respectively.

18. The display device according to claim 16, wherein the display panel further comprises silver a gluing spot located in the non-display area;

wherein at least one of the first driving unit and the second driving unit further comprises a third grounding pin and a fourth grounding pin, the third grounding pin is electrically connected to the peripheral ground line, the fourth grounding pin is electrically connected to a silver glue dot through a silver glue dot ground line.

19. The display device according to claim 13, wherein the display panel has a display area and a non-display area, the display panel further comprises a test line, a peripheral ground line, a common electrode line, and silver glue dots, the test line is located in the non-display area, the common electrode line is located in the display area, the peripheral ground line is located in the non-display area at the periphery of the display area and is located on a side of the test line away from the display area, and the silver glue dots are located in the non-display area;

the driving units are arranged in a target direction; the first driving unit and the second driving unit further respectively comprise a test pin, a feed pin, a second grounding pin, a third grounding pin, and a fourth grounding pin; each of the third driving units further comprises a third grounding pin and a fourth grounding pin;

in the first driving unit: the third grounding pin, the fourth grounding pin, the test pin, the M dummy pins, the feed pin, the first grounding pin and the second grounding pin are arranged sequentially in a direction of approaching the second driving unit;

in the second driving unit: the third grounding pin, the fourth grounding pin, the test pin, the M dummy pins, the feed pin, the first grounding pin, and the second grounding pin are arranged sequentially in a direction of approaching the first driving unit;

in the third driving unit: the third grounding pin, the first grounding pin, the second grounding pin, and the fourth grounding pin are arranged sequentially in a direction from the first driving unit to the second driving unit;

the first grounding pin of the first driving unit is electrically connected to the first grounding pin of a third driving unit adjacent thereto, and the second grounding pin of the first driving unit is electrically connected to the third grounding pin of the third driving unit adjacent thereto;

the first grounding pin of the second driving unit is electrically connected to the second grounding pin of a third driving unit adjacent thereto, and the second grounding pin of the second driving unit is electrically connected to the fourth grounding pin of the third driving unit adjacent thereto;

the first grounding pin of any of other third driving units is electrically connected to the second grounding pin of a third driving unit adjacent thereto and located therebefore, the second grounding pin of any of other third driving units is electrically connected to the first grounding pin of a third driving unit adjacent thereto and located thereafter, the third grounding pin of any of other third driving units is electrically connected to the fourth grounding pin of a third driving unit adjacent thereto and located therebefore, and the fourth grounding pin of any of other third driving units is electrically connected to the third grounding pin of a third driving unit adjacent thereto and located thereafter, wherein the other third driving units are third driving units other than the third driving unit adjacent to the first driving unit and the third driving unit adjacent to the second driving unit;

the test pins are electrically connected to the test line, and the test pins are configured to transmit test signals to the test line during a test phase of the display panel and ground the test line during a display phase of the display panel;

the feed pins are electrically connected to the common electrode line, and the each of feed pins is configured to transmit one of a feed signal and a compensation signal to the common electrode line; and each of the fourth grounding pin of the first driving unit and the fourth grounding pin of the second driving unit is configured to be electrically connected to a silver glue dot of the display panel through a silver glue dot ground line, and grounding pins other than the fourth grounding pin of the first driving unit and the fourth grounding pin of the second driving unit are electrically connected to the peripheral ground line.

20. The display device according to claim 13, wherein at least one of the driving units comprises ten dummy pins; each of the driving units comprises a plurality of pins, a width of the pin is 16 to 18 microns, and a spacing between any two adjacent pins is 16 to 18 microns; and the driving circuit is a chip-on-film circuit.

* * * * *